US009409409B2

(12) United States Patent
Iwase et al.

(10) Patent No.: US 9,409,409 B2
(45) Date of Patent: Aug. 9, 2016

(54) INK SUPPLY SYSTEM, INK-JET PRINTER, INK LOADING METHOD, AND METHOD OF USING INK SUPPLY SYSTEM

(71) Applicant: ROLAND DG CORPORATION, Shizuoka-ken (JP)

(72) Inventors: Fumiyoshi Iwase, Shizuoka-ken (JP); Kazuya Morizono, Shizuoka-ken (JP)

(73) Assignee: ROLAND DG CORPORATION, Shizuoka-ken (JP)

( * ) Notice: Subject to any disclaimer, the term of this patent is extended or adjusted under 35 U.S.C. 154(b) by 0 days.

(21) Appl. No.: 14/866,440

(22) Filed: Sep. 25, 2015

(65) Prior Publication Data

US 2016/0089895 A1 Mar. 31, 2016

(30) Foreign Application Priority Data

Sep. 29, 2014 (JP) ..... 2014-198919

(51) Int. Cl.
*B41J 2/175* (2006.01)

(52) U.S. Cl.
CPC ..... *B41J 2/17566* (2013.01); *B41J 2/17596* (2013.01)

(58) Field of Classification Search
CPC .... B41J 2/175; B41J 2/17506; B41J 2/17523; B41J 2/17566; B41J 2/17596
USPC ..... 347/7, 19, 29, 30, 84, 85, 86
See application file for complete search history.

(56) References Cited

U.S. PATENT DOCUMENTS 6,199,976 B1 * 3/2001 Sasada ..... B41J 2/1707 347/85
6,783,200 B2 * 8/2004 Suenaga ..... B41J 2/17566 347/7
7,845,784 B2 * 12/2010 Nitta ..... B41J 2/175 347/89
8,136,906 B2 * 3/2012 Iwasaki ..... B41J 2/175 347/17
8,336,999 B2 * 12/2012 Matsumoto ..... B41J 2/17509 347/85
8,534,785 B2 * 9/2013 Asami ..... B41J 2/175 347/14

* cited by examiner

*Primary Examiner* — Anh T. N. Vo
(74) *Attorney, Agent, or Firm* — Lee, Hong, Degerman, Kang & Waimey PC; Jonathan Kang; Justin Lee

(57) ABSTRACT

An ink supply system, inkjet printer, and ink loading method are provided. The ink supply system includes an ink head comprising a nozzle; first and second ink containers; a first ink supply passage; a second ink supply passage; an ink amount detecting device configured to detect an amount of ink in the first ink container; and a notifying device to provide a notification when the detected amount of ink is less than or equal to a threshold amount.

17 Claims, 10 Drawing Sheets

INK SUPPLY SYSTEM, INK-JET PRINTER, INK LOADING METHOD, AND METHOD OF USING INK SUPPLY SYSTEM

CROSS-REFERENCE TO RELATED APPLICATIONS

Pursuant to 35 U.S.C. §119(a), this application claims the benefit of earlier filing date and right of priority to Japanese Patent Application No. 2014-198919, filed on Sep. 29, 2014, the contents of which are hereby incorporated by reference herein in its entirety.

The present invention relates to an ink supply system, an ink-jet printer, an ink loading method, and a method of using the ink supply system.

BACKGROUND

Conventionally, an ink-jet printer includes an ink head provided with an ink cartridge for supplying ink and, in addition, another ink container to increase the usable ink amount.

For example, conventional ink-jet printers include a relay cartridge connected to an ink head and an additional ink container connected to the relay cartridge. When ink of the relay cartridge is fed to the ink head, ink is supplied to the relay cartridge from the additional ink container. The content of the additional ink container may be larger than the content of the relay cartridge, thus the ink-jet printer can increase the usable amount of ink.

When the additional ink container of the conventional ink-jet printer becomes empty, the additional ink container is exchanged with another additional ink container. However, conventional ink-jet printers include a detecting mechanism which detects the ink amount, and is built into the additional ink container. Therefore, the detecting mechanism needs to be manufactured every time a shape or content of the additional ink container is changed and designing and manufacturing detecting mechanisms has become increasingly costly. Further, some conventional ink-jet printers supply ink to the ink head via a relay cartridge from the additional ink container. When printing, ink flows at all times in the relay cartridge including the detecting mechanism, and the relay cartridge is likely to deteriorate due to extensive use of the relay cartridge over a long period of time.

Hence, providing an ink supply system which increases the usable ink amount and has an ink container provided with a detecting mechanism to prevent wear and deterioration may be advantageous.

SUMMARY

Embodiments of the present disclosure include an ink supply system comprising an ink head comprising a nozzle and configured to eject ink; a first ink container configured to store ink; a second ink container configured to store ink; and a first ink supply passage. In some embodiments, the first ink supply passage includes: a first upstream end portion coupled to the first ink container; a first downstream end portion coupled to the ink head; an intermediate portion positioned between the first upstream end portion and the first downstream end portion; a second ink supply passage. The second ink supply passage may include a second upstream end portion coupled to the second ink container; and a second downstream end portion coupled to the intermediate portion, wherein ink from the second ink container is supplied to the ink head via the second upstream end portion, the second downstream portion, the intermediate portion, and the first downstream end portion; an ink amount detecting device configured to detect an amount of ink in the first ink container; and a notifying device configured to provide a notification when the detected amount of ink is less than or equal to a threshold amount.

According to an embodiment of the present invention, the second ink container is arranged at a higher position than the first ink container.

According to an embodiment of the present invention, a hydraulic head difference makes it possible to supply the ink of the second ink container to the ink head instead of the ink of the first ink container.

According to another embodiment of the present invention, a flow passage resistance of an upstream side portion of the intermediate portion is higher than a flow passage resistance of an upstream side portion of the second downstream end portion. In this regard, an inner diameter of the upstream side portion of the intermediate portion may be smaller than an inner diameter of the upstream side portion of the second ink supply passage.

According to still another embodiment of the present invention, the second downstream end portion is coupled to the intermediate portion at an end of the intermediate portion nearest the first upstream end portion.

According to another embodiment of the present invention, the first ink supply passage further comprises a first valve between the intermediate portion and the first downstream end portion.

According to another embodiment of the present invention, the second ink supply passage further comprises a second valve.

According to yet another embodiment of the present invention, the ink supply system includes a cap coupled to the ink head and configured to cover the nozzle, and a suction pump configured to suction air from the cap.

An ink-jet printer according to an embodiment of the present invention may include one or various embodiments of the above-described ink supply systems.

Additionally, a method of supplying ink to an ink supply system according to an embodiment of the present invention may include connecting a first ink container to a first upstream end portion of a first ink supply passage, the first ink supply comprising: the first upstream end portion; a first downstream end portion coupled to an ink head; an intermediate portion positioned between the first upstream end portion and the first downstream end portion; and a first valve between the first upstream end portion and the intermediate portion; opening the first valve of the first ink supply passage; closing a second valve of a second ink supply passage, the second ink supply passage comprising a second upstream end portion coupled to a second ink container and a second downstream end portion coupled to the intermediate portion; discharging air from the first ink container, the first ink supply passage, and the second ink supply passage; and providing ink from the second ink container to the second ink supply passage, the first ink supply passage, and the first ink container by no longer discharging the air and opening the second valve.

According to another embodiment of the present invention, the ink supplying method may include depressurizing the first ink container by closing the second valve and causing the suction pump to continue suctioning air from the cap; and loading ink in the second ink container by no longer discharging the air and opening the second valve. The method may further include closing the first valve; and detaching the first ink container from the first upstream end portion after closing the first valve and the second valve.

Other embodiments of a method of supplying ink according to the present invention may further include the second ink container arranged at a higher position than the first ink container, wherein a flow passage resistance of an upstream side portion of the intermediate portion is higher than a flow passage resistance of an upstream side portion of the second downstream end portion, wherein an inner diameter of the upstream side portion of the intermediate portion is smaller than an inner diameter of the upstream side portion, or wherein the second downstream end portion is coupled to the intermediate portion at an end of the intermediate portion nearest the first upstream end portion.

BRIEF DESCRIPTION OF THE DRAWINGS

The above and other aspects and features of the present disclosure will become more apparent upon consideration of the following description of embodiments, taken in conjunction with the accompanying drawing figures.

DETAILED DESCRIPTION

In the following detailed description, reference is made to the accompanying drawing figures which form a part hereof, and which show by way of illustration specific embodiments of the present invention. It is to be understood by those of ordinary skill in this technological field that other embodiments may be utilized, and that structural, electrical, as well as procedural changes may be made without departing from the scope of the present invention. Wherever possible, the same reference numbers will be used throughout the drawings to refer to the same or similar parts.

Figure 1:
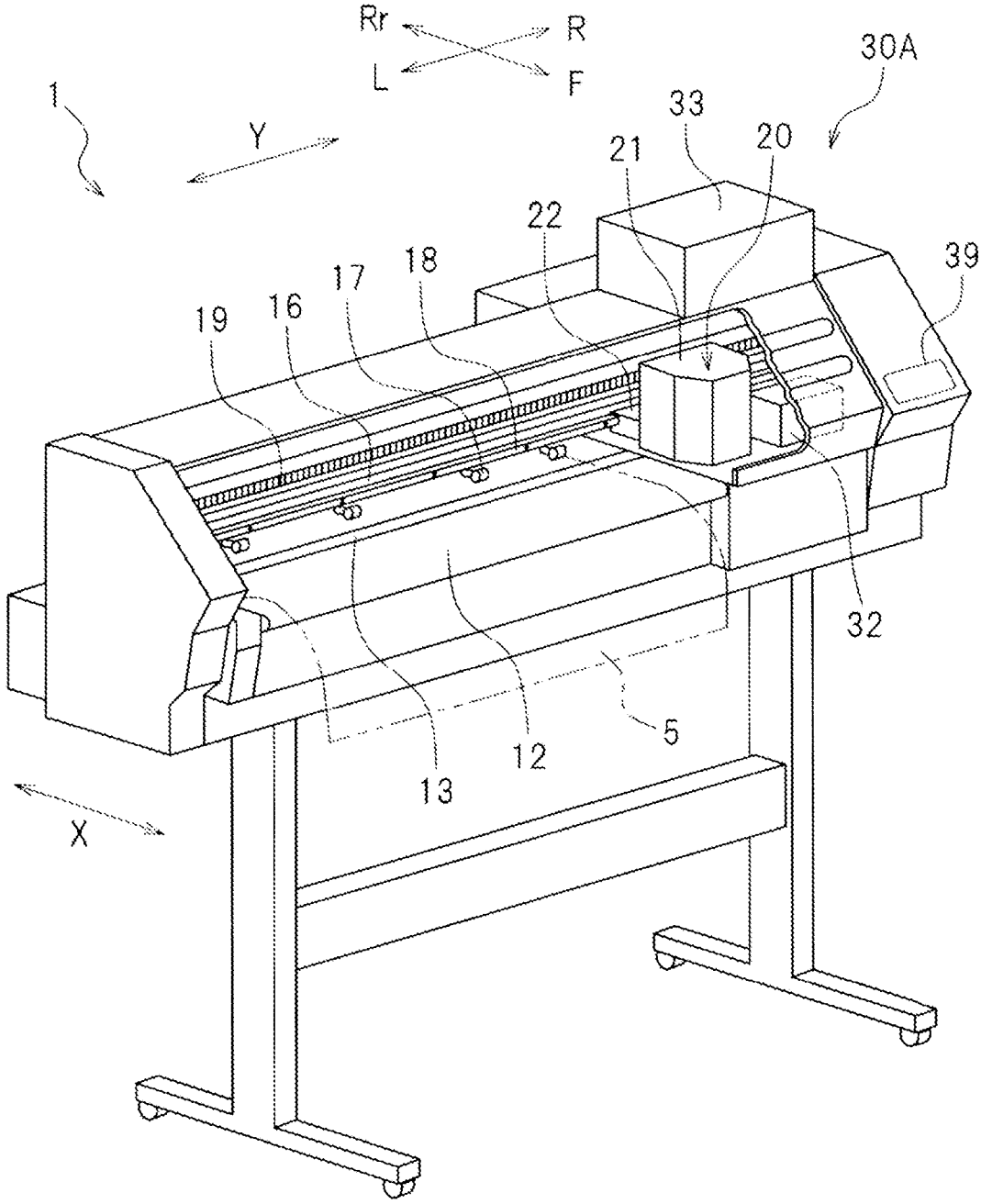
FIG. 1 is a perspective view of a printer according to an embodiment of the present disclosure.

FIG. 1 is a perspective view illustrating a printer 1 according to an embodiment of the present disclosure, which includes a cut-out portion of the printer 1 for discussion purposes. As illustrated in FIG. 1, the printer 1 according to the present embodiment is an ink-jet printer which performs printing on a recording medium 5.

The recording medium 5 is, for example, a recording sheet. In this regard, the recording medium 5 is not limited to recording paper. For example, the recording medium 5 may include a sheet recording medium such as a resin sheet.

Further, various flexibility and thickness values of the recording medium 5 are contemplated by this disclosure. For example, the recording medium 5 may include a hard medium such as a glass substrate or a medium having a thickness such as a cardboard.

In FIG. 1, symbols F, Rr, L and R indicate directions of a front, a rear, a left and a right, respectively, for discussion purposes only. An ink head 20 may be included and configured to move left and right, and the recording medium 5 can be conveyed to the front and the back.

A moving direction of the ink head 20 and a conveying direction of the recording medium 5 will be referred to as a main scan direction Y and a sub scan direction X, respectively. In this regard, the main scan direction Y may correspond to left and right directions, and the sub scan direction X may correspond to front and back directions.

The main scan direction Y is orthogonal to the sub scan direction X. However, the main scan direction Y and the sub scan direction X are not thusly limited, and may be optionally set according to a mode of the printer 1 in other embodiments. Further, a device which moves a table on which recording media are set to the front, the back, the left and the right may be provided as a conveying device.

In the present embodiment, the printer 1 includes a platen 12 which supports the recording medium 5. The platen 12 is provided with a cylindrical grid roller 13. The grid roller 13 is positioned in the platen 12 in a state where a top surface portion of the grid roller 13 is exposed. The grid roller 13 is driven by a feed motor which is not illustrated.

A guide rail 16 is arranged above the platen 12. The guide rail 16 is arranged parallel to the platen 12, and extends to the left and the right. A plurality of pinch rollers 17 are arranged at equal or nearly equal intervals below the guide rail 16. The pinch rollers 17 are positioned opposite the grid roller 13. The pinch rollers 17 are configured such that the positions of the pinch rollers 17 in a vertical direction can be set according to the thickness of the recording medium 5, and sandwich the recording medium 5 together with the grid roller 13. The grid roller 13 and the pinch rollers 17 are configured to be conveyed to the front and the back while sandwiching the recording medium 5. The guide rail 16 includes an engagement portion 18 which projects forward.

Next, an embodiment of an ink supply system 30A will be described. In the present embodiment, the printer 1 includes the ink supply system 30A.

Figure 2:
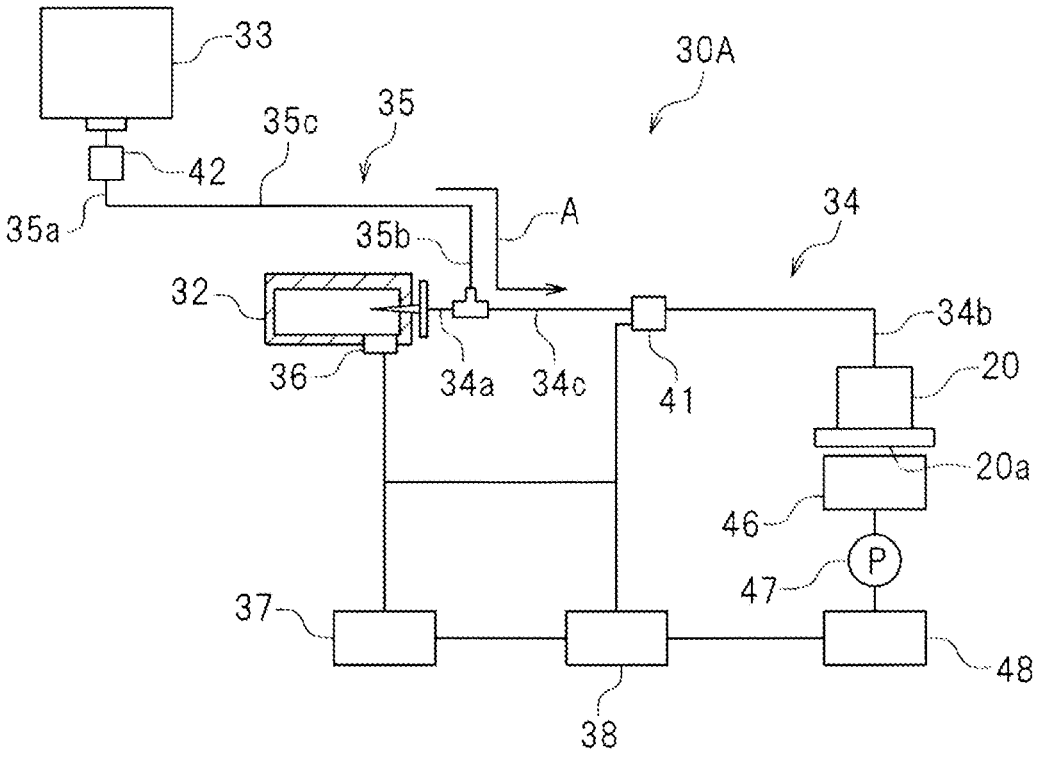
FIG. 2 is a schematic view illustrating an ink supply system according to an embodiment of the present disclosure.

FIG. 2 is a schematic view illustrating the ink supply system 30A. As illustrated in FIG. 2, the ink supply system 30A includes the ink head 20, a first pouch 32, a second pouch 33, a first ink supply passage 34, a second ink supply passage 35, an ink amount detecting device 36, and a notifying device 37. The ink head 20 ejects ink to the recording medium 5. The ink head 20 includes a nozzle 20*a* which ejects ink.

As illustrated in FIG. 1, the ink head 20 may be housed in a case 21. At a back surface of the case 21, a carriage 22 is provided. At a rear side portion of the carriage 22, a concave portion which is curved forward is formed. This concave portion engages with the engagement portion 18 of the guide rail 16. The carriage 22 can move along the guide rail 16, and move in the main scan direction Y. The ink head 20 is guided in the main scan direction Y along the guide rail 16 via the carriage 22. At an upper portion of the back surface of the case 21, part of a driving belt 19 which extends to the left and the right may be fixed. The driving belt 19 is connected to a scan motor which is not illustrated, and is driven by this scan motor. The ink head 20 is driven by this scan motor via the driving belt 19.

As illustrated in FIG. 2, the ink supply system 30A includes a cap 46 and a suction pump 47. The cap 46 prevents ink at the nozzle 20*a* of the ink head 20 from curing, and further prevents the ink from jamming in the nozzle 20*a*. The cap 46 is attached to the ink head 20 to cover the nozzle 20*a* of the ink head 20 when printing is not being performed. The suction pump 47 suctions air from the cap 46.

In this regard, the suction pump 47 is connected or otherwise operably coupled to the cap 46. The suction pump 47 is also connected or otherwise operably coupled with a driving motor 48. When the driving motor 48 is driven and the suction pump 47 is operated in a state where the cap 46 is attached to the ink head 20, the suction pump 47 suctions air from the cap 46, the ink head 20, the first ink supply passage 34, the second ink supply passage 35, and the first pouch 32.

The first pouch 32 is configured to store ink. The amount of ink which the first pouch 32 can store will be referred to as a first content. The first pouch 32 is fixed to a main body of the printer 1. The first pouch 32 may be fixed to the ink head 20. In some embodiments, the first pouch 32 may be provided at a position apart from the printer 1.

The second pouch 33 is also configured to store an ink. The amount of ink which the second pouch 33 can store will be referred to as a second content. In some embodiments, the second content is larger than the first content of the first pouch 32; that is, in such embodiments the second pouch 33 may store more ink than the first pouch 32. However in some embodiments the second content may be smaller than the first content or may be the same as the first content.

The second pouch 33 is fixed to the main body of the printer 1. However in other embodiments, the second pouch 33 may be provided apart from the printer 1.

As illustrated in FIG. 1, the second pouch 33 is arranged at a higher position than the first pouch 32. In some embodiments, the ink stored in the first pouch 32 and the second pouch 33 are degassed ink types, however this is not to be limiting and other ink types known to those of ordinary skill in the art are also contemplated and may be used in conjuction with the embodiments of this disclosure.

As illustrated in FIG. 2, the first ink supply passage 34 is a passage which supplies the ink of the first pouch 32 or the second pouch 33 to the ink head 20. In an embodiment, the first ink supply passage 34 is formed as a tube having flexibility, however the material of the first ink supply passage 34 is not thusly limited. The first ink supply passage 34 may include a first upstream end portion 34*a*, a first downstream end portion 34*b*, and a first intermediate portion 34*c*. The first upstream end portion 34*a* comprises an upstream portion of the first ink supply passage 34. The first upstream end portion 34*a* is detachably connected or otherwise coupled to the first pouch 32.

In other embodiments, the first upstream end portion 34*a* may be undetachably connected to the first pouch 32. Thus, it is possible to prevent ink from leaking from a connection portion of the first upstream end portion 34*a* and the first pouch 32.

The first downstream end portion 34*b* comprises a downstream portion of the first ink supply passage 34. The first downstream end portion 34*b* is connected or operably coupled to the ink head 20. The first intermediate portion 34*c* comprises an intermediate portion of the first ink supply passage 34. In this regard, the first intermediate portion 34*c* may be positioned between the first upstream end portion 34*a* and the first downstream end portion 34*b*.

In an embodiment, the ink supply system 30A includes a choke valve 41. The choke valve 41 is a valve which opens and closes the first ink supply passage 34. The choke valve 41 is provided between the first intermediate portion 34*c* and the first downstream end portion 34*b* of the first ink supply passage 34. In this regard, the choke valve 41 opens and closes a portion between the first intermediate portion 34*c* and the first downstream end portion 34*b* of the first ink supply passage 34.

The second ink supply passage 35 is a passage which is configured to supply the ink of the second pouch 33 to the first ink supply passage 34. In some embodiments, the second ink supply passage 35 may be formed as a tube having flexibility. However, the material of the second ink supply passage 35 is not thusly limited.

The second ink supply passage 35 may include a second upstream end portion 35*a*, a second downstream end portion 35*b*, and a second intermediate portion 35*c*. The second upstream end portion 35*a* comprises an upstream end portion of the second ink supply passage 35. The second upstream end portion 35*a* is detachably connected or otherwise operably coupled to the second pouch 33. The second downstream end portion 35*b* comprises a downstream portion of the second ink supply passage 35.

The second downstream end portion 35*b* is connected or otherwise operably coupled to the intermediate portion 34*c* of the first ink supply passage 34. The second intermediate portion 35*c* comprises an intermediate portion of the second ink supply passage 35.

In this regard, the second intermediate portion 35*c* may be positioned between the second upstream end portion 35*a* and the second downstream end portion 35*b*. In some embodiments, the flow passage resistances of the upstream side portions of the first upstream end portion 34*a* and the first intermediate portion 34*c* of the first ink supply passage 34 may be higher than the flow passage resistances of the upstream side portions of the second intermediate portion 35*c* and the second downstream end portion 35*b* of the second ink supply passage 35.

In this regard, the inner diameters of the upstream side portions of the first upstream end portion 34*a* and the first intermediate portion 34*c* of the first ink supply passage 34 may be narrower than the inner diameters of the upstream side portions of the second intermediate portion 35*c* and the second downstream end portion 35*b* of the second ink supply passage 35. However in other embodiments, the flow passage resistances of the second upstream end portion 35*a*, the second intermediate portion 35*c*, and the second downstream end portion 35*b* of the second ink supply passage 35 may be the same.

The flow passage resistance of the second ink supply passage 35 may be lower than the flow passage resistance of the upstream side portions of the first upstream end portion 34*a* and the first intermediate portion 34*c* of the first ink supply passage 34. In this regard, the inner diameters of the second upstream end portion 35*a*, the second intermediate portion 35*c*, and the second downstream end portion 35*b* of the second ink supply passage 35 may be the same or may be different. The inner diameter of the second ink supply passage 35 may be wider than the inner diameters of the upstream side portions of the first upstream end portion 34*a* and the first intermediate portion 34*c* of the first ink supply passage 34.

In some embodiments, the ink supply system 30A includes a detachable valve 42 provided at the second ink supply passage 35. The detachable valve 42 may be configured to open or close the second ink supply passage 35 and adjusts the flow of ink from the second pouch 33 to the second ink supply passage 35.

In this regard, the detachable valve 42 may be provided at an upstream end of the second upstream end portion 35*a* of the second ink supply passage 35. The detachable valve 42 may be configured to open or close the second ink supply passage in association with the attachment or detachment of the second pouch 33 to or from the second upstream end portion 35*a*.

More specifically, in some embodiments when the second pouch 33 is connected to the second upstream end portion 35*a*, the detachable valve 42 is opened, and the second ink supply passage 35 is opened. When the second pouch 33 is detached from the second upstream end portion 35*a*, the detachable valve 42 is closed, and the second ink supply passage 35 is closed.

Thus in some embodiments, when the ink head 20 ejects ink, the ink of the second pouch 33 is supplied to the ink head 20 via the second upstream end portion 35*a*, the second intermediate portion 35*c*, and the second downstream end portion 35*b* of the second ink supply passage 35, and the first intermediate portion 34*c* and the first downstream end portion 34*b* of the first ink supply passage 34. Another embodiment includes the ink amount detecting device 36 provided at the first pouch 32.

The ink amount detecting device 36 may be configured to detect the ink amount of the first pouch 32 and that the ink amount of the first pouch 32 is equal to or less than a predetermined content value. This predetermined content value may be stored in advance in a storage unit (not illustrated) of a control device 38 which will be described below. The configuration of the ink amount detecting device 36 is not limited to the discussion herein, and may employ various configurations known to those of ordinary skill in the art.

For example, in some embodiments, the ink amount detecting device 36 includes an upper plate and a lower plate part of which contacts the first pouch 32 and which are positioned opposite each other while sandwiching the first pouch 32. The ink amount detecting device 36 may further include a photosensor which is provided at the lower plate and external to the first pouch, and a detection piece which is provided at the upper plate at a position opposite to the photosensor and which can contact the photosensor when the first pouch 32 contracts. In the ink amount detecting device 36, when the first pouch 32 contracts and the detection piece contacts the photosensor, the photosensor may detect that the ink amount of the first pouch 32 is less than or equal to the predetermined content value.

A notifying device 37 may further be provided and configured to send a notification when the ink amount detecting device 36 detects that the ink amount of the first pouch 32 is less than or equal to the predetermined content value. A configuration of this notifying device 37 is not limited to this discussion and may include various configurations known to those of ordinary skill in the art. For example, the notifying device 37 may include an operation panel 39 (shown in FIG. 1) provided to at a right portion of the printer 1. When the ink amount detecting device 36 detects that the ink amount of the first pouch 32 is less than or equal to the predetermined content value, the notifying device 37 may display an indication by way of characters or light on the operation panel 39. Further, when the ink amount detecting device 36 detects that the ink amount of the first pouch 32 is less than or equal to the predetermined content value, the notifying device 37 may notify a user by a sound or vibration. The notifying device 37 may be provided at the printer 1 in some embodiments, and in other embodiments the notifying device 37 may be provided at an external personal computer or a mobile terminal.

In an embodiment, the ink supply system 30A includes a control device 38. The control device 38 is not limited to any particular configuration, for example, the control device 38 may correspond to a computer, and may include various hardware and components known to those of ordinary skill in the art, including but not limited to a central processing unit (referred to as a CPU), a ROM in which information processed by the CPU are stored, and a RAM.

The control device 38 may be operably coupled to the choke valve 41, the driving motor 48 connected to the suction pump 47, the ink amount detecting device 36, and the notifying device 37. The control device 38 may be configured to control the choke valve 41 to open and close the first ink supply passage 34 and cause the suction pump 47 to operate by driving the driving motor 48. When the ink amount detecting device 36 detects that the ink amount of the first pouch 32 is less than or equal to the predetermined content value, the control device 38 may control the notifying device 37 to send a notification to the user.

Next, embodiments of an operation for supplying an ink to the ink head 20 will be described. As illustrated in FIG. 1, the second pouch 33 may be arranged at a higher position than the first pouch 32. Further, the flow passage resistance of the upstream side portion of the first intermediate portion 34*c* of the first ink supply passage 34 may be higher than the flow passage resistance of the upstream side portion of the second downstream end portion 35*b* of the second ink supply passage 35.

Figure 3:
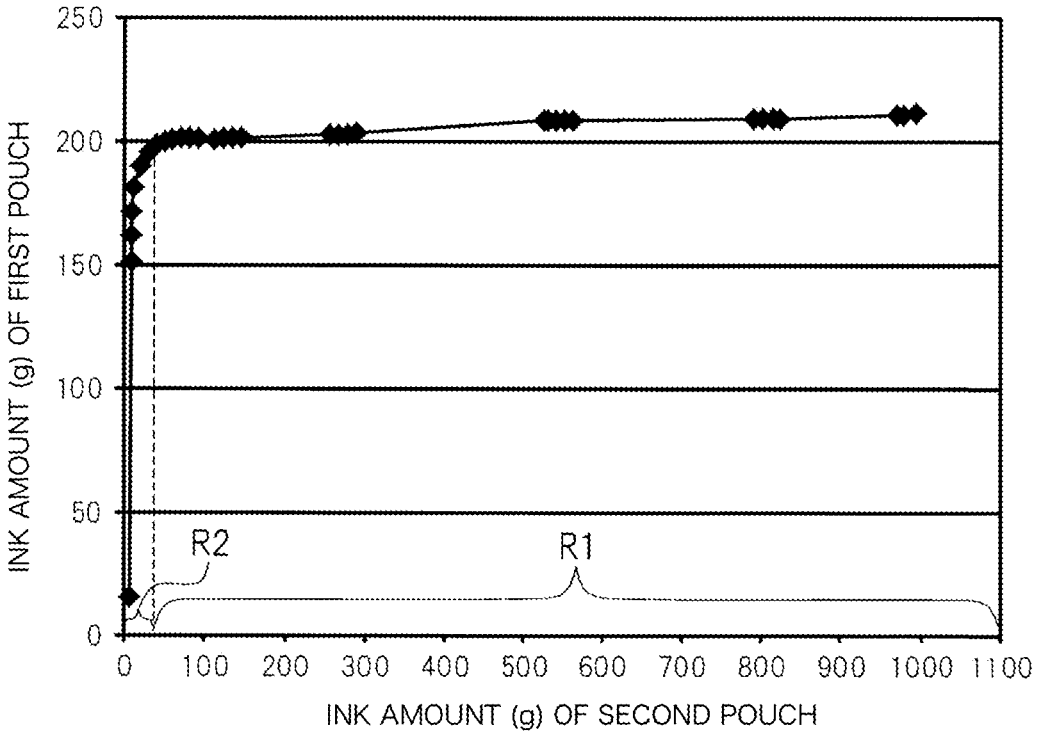
FIG. 3 is a graph illustrating an ink amount of a first container and an ink amount of a second container according to an embodiment of the present disclosure.
Figure 4:
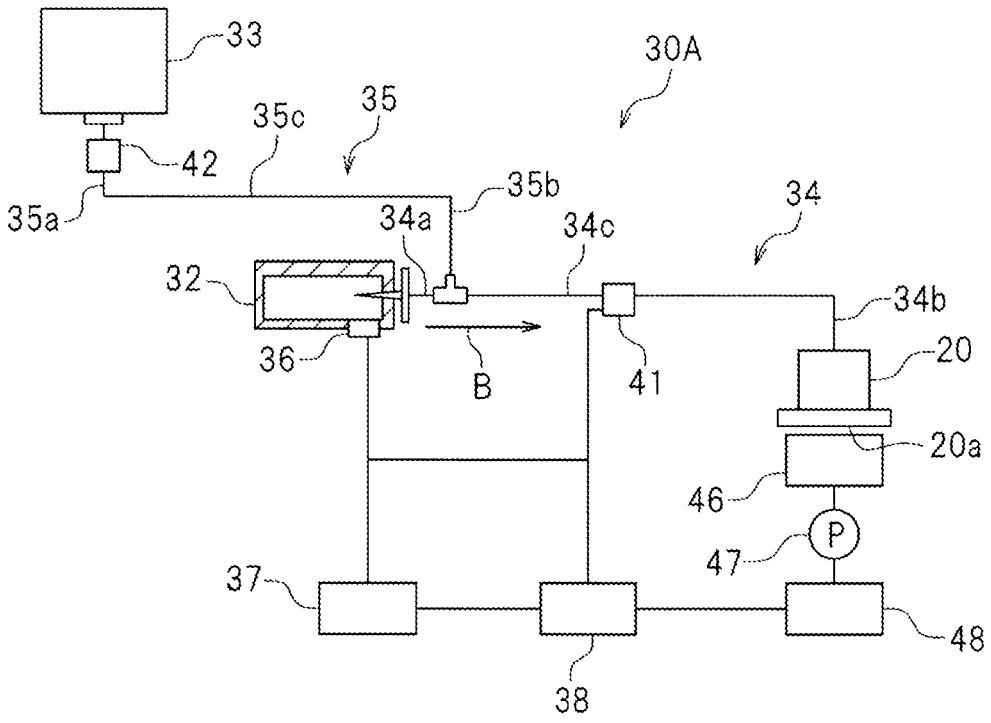
FIG. 4 is a schematic view of the ink supply system showing ink flow according to another embodiment of the present disclosure.

FIG. 3 is a graph illustrating a relationship between the ink amount of the first pouch 32 and the ink amount of the second pouch 33. FIG. 4 is a schematic view of the ink supply system 30A further illustrating an ink flow.

As illustrated in FIG. 3, when ink remains in the first pouch 32 and the second pouch 33 (shown by range R1 in FIG. 3), the ink of the second pouch 33 is supplied to the ink head 20 via the second upstream end portion 35*a*, the second intermediate portion 35*c*, the second downstream end portion 35*b* of the second ink supply passage 35, and the first intermediate portion 34*c* and the first downstream end portion 34*b* of the first ink supply passage 34. The ink is supplied to the ink head 20 as indicated by arrow A in FIG. 2.

In this case, the ink of the second pouch 33 does not circulate to the first pouch 32. The ink of the first pouch 32 is not supplied to the ink head 20. Thus the ink amount of the first pouch 32 does not substantially decrease.

When the remaining ink amount of the second pouch 33 is reduced (shown by range R2 in FIG. 3), the ink of the first pouch 32 is supplied to the ink head 20. More specifically, when the remaining ink amount of the second pouch 33 is reduced, the ink of the first pouch 32 is supplied to the ink head 20 via the first upstream end portion 34*a*, the first intermediate portion 34*c*, and the first downstream end portion 34*b* of the first ink supply passage 34.

The ink is supplied to the ink head 20 as indicated by arrow B in FIG. 4. Thus, in this embodiment, the ink of the second pouch 33 is first supplied to the ink head 20 and, when the remaining ink amount of the second pouch 33 is reduced, the ink of the first pouch 32 is supplied to the ink head 20.

Figure 5:
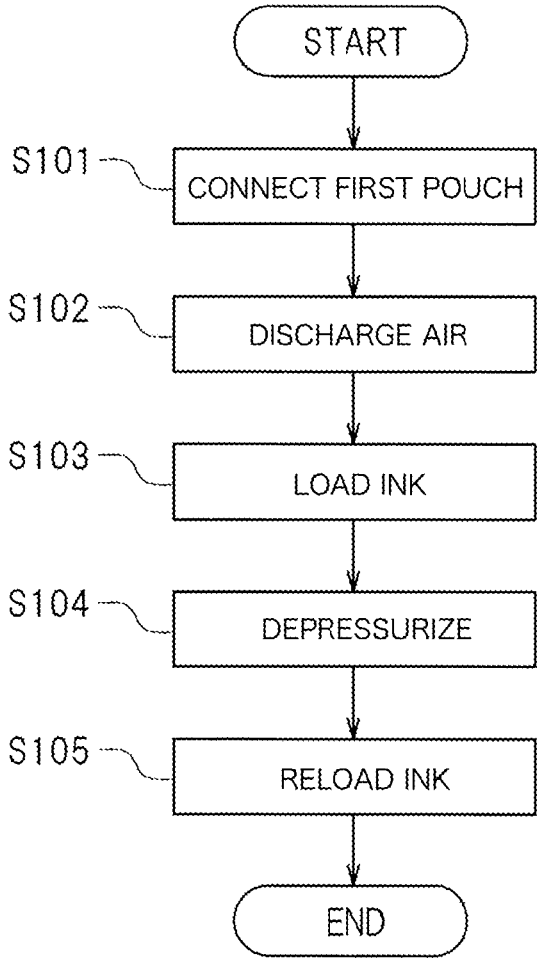
FIG. 5 is a flowchart illustrating a process of loading ink to a first container, a first ink supply passage, and a second ink supply passage according to an embodiment of the present disclosure.

Next, a process of loading the ink to the first pouch 32, the first ink supply passage 34, and the second ink supply passage 35 in an empty state of the first pouch 32 will be described. FIG. 5 is a flowchart illustrating a process of loading an ink to the first pouch 32, the first ink supply passage 34, and the second ink supply passage 35. FIGS. 6 to 9 are schematic views of the ink supply system 30A illustrating processes of loading an ink to the first pouch 32, the first ink supply passage 34, and the second ink supply passage 35.

Figure 6:
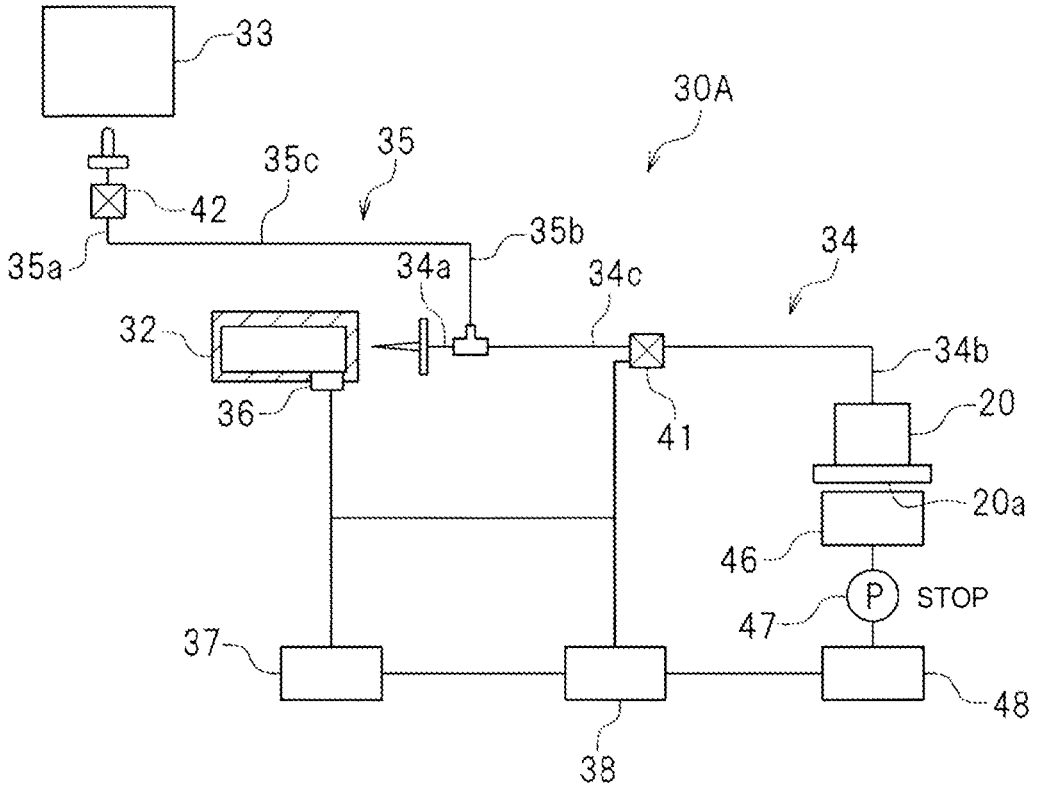
FIGS. 6, 7, 8, and 9 are schematic views illustrating an ink supply system according to various embodiments of the present disclosure.

As illustrated in FIG. 6, before ink is loaded to the first pouch 32, the first ink supply passage 34, and the second ink supply passage 35, the first pouch 32 may be detached from the first upstream end portion 34*a* of the first ink supply passage 34. The second pouch 33 may also be detached from the second upstream end portion 35*a* of the second ink supply passage 35. The choke valve 41 and the detachable valve 42 are closed.

In this regard, as described above, the first pouch 32 is not loaded with ink and is in an empty state. The second pouch 33 is loaded with ink.

Figure 7:
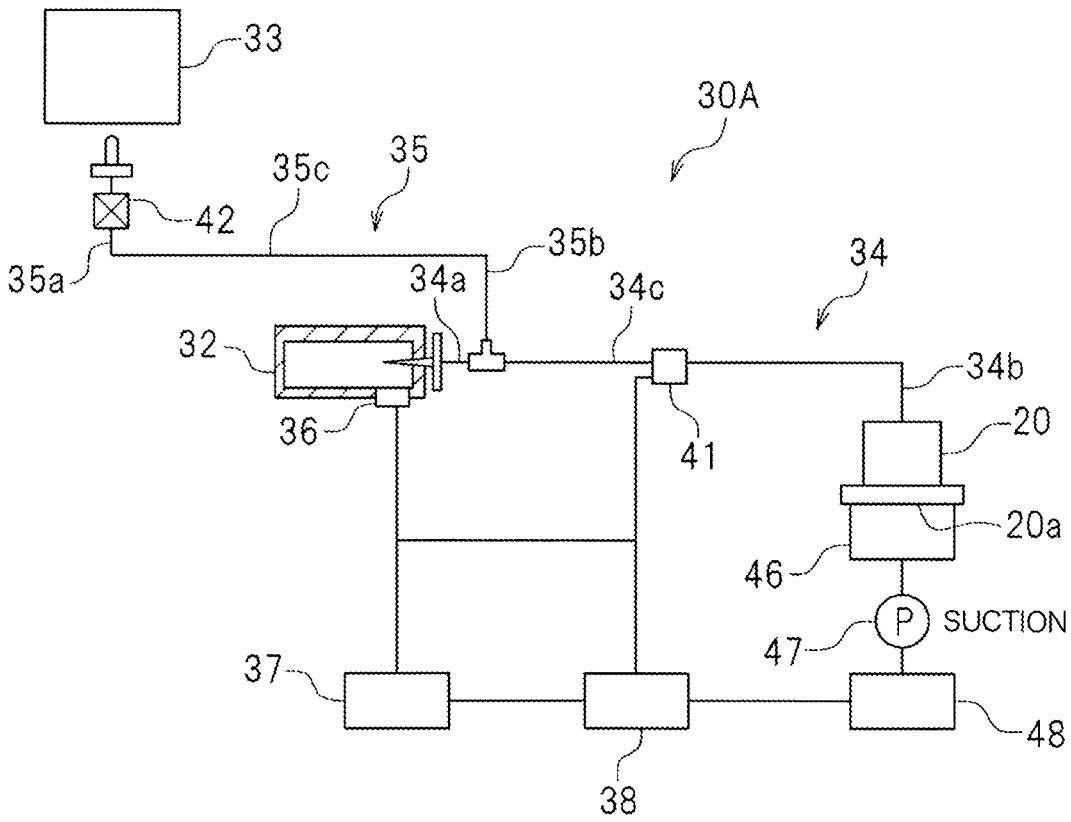

As illustrated in FIG. 5, an embodiment of a method of loading ink may include a step (step S101) of connecting the first pouch 32. In this regard, S101 may include opening the choke valve 41 provided to the first ink supply passage 34, as illustrated in FIG. 7. Thereby, the first ink supply passage 34 is opened. Connecting the first pouch may further include closing the detachable valve 42 provided to the second ink supply passage 35 since the second pouch 33 is detached from the second ink supply passage 35, and connecting the empty first pouch 32 to the first upstream end portion 34*a* of the first ink supply passage 34.

The embodiment may further include an air discharging step at S102 illustrated in FIG. 5. In this regard, the air discharging step may include attaching the cap 46 to the nozzle 20*a* of the ink head 20, as illustrated in FIG. 7.

The air discharging may further include causing the suction pump 47 connected to the cap 46 to operate by driving the driving motor 48. In addition, air discharging may also include opening the choke valve 41. Thus, air in the first pouch 32, the first ink supply passage 34, and the second ink supply passage 35 is externally discharged.

Figure 8:
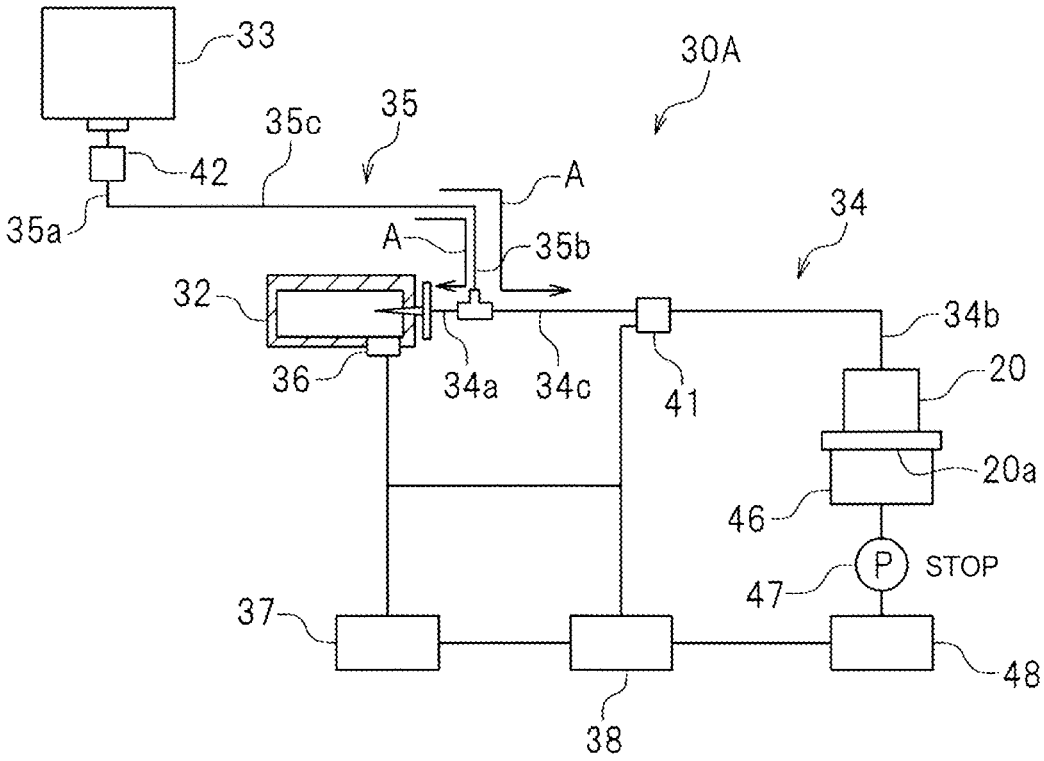

As illustrated in FIG. 5, the embodiment may further include an ink loading step at S103. As illustrated in FIG. 8, the ink loading step may include causing the control device 38 to stop the driving motor 48, thus stopping the suction pump 47. The ink loading step may further include connecting the second pouch 33 to the second upstream end portion 35*a* of the second ink supply passage 35, and opening the detachable valve 42.

When the second pouch 33 is connected to the second upstream end portion 35*a*, the ink of the second pouch 33 is loaded to the second ink supply passage 35, the first ink supply passage 34, and the first pouch 32. The ink flows as indicated by arrow A in FIG. 8.

As illustrated in FIG. 5, the ink loading method may further include a depressurizing step at S104. In this regard, depressurizing may include detaching the second pouch 33 again from the second upstream end portion 35*a* of the second ink supply passage 35, closing the detachable valve 42, and opening the choke valve 41. Further, depressurizing may include causing the suction pump 47 to operate again by driving the driving motor 48. If air remains in the first pouch 32, the first ink supply passage 34, and the second ink supply passage 35, the suction pump 47 can discharge this air, and as a result, the first pouch 32 is depressurized.

Figure 9:
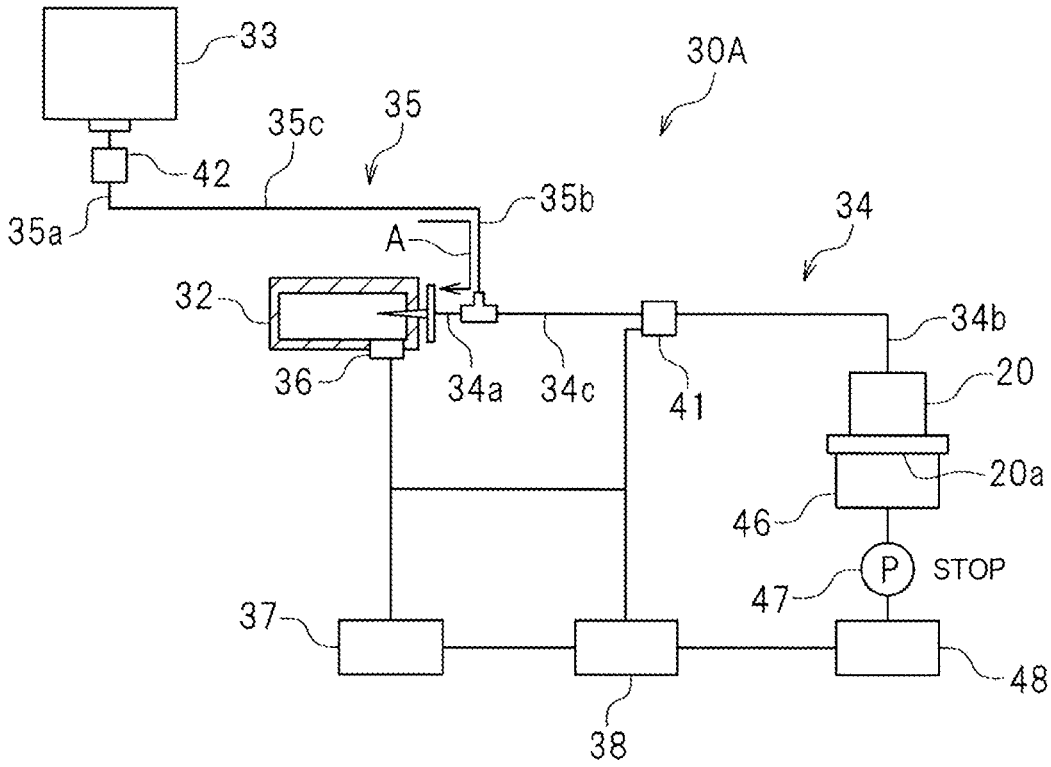

Next, as illustrated in FIG. 5, an ink reloading step at S105 is performed. The ink reloading may include stopping the suction pump 47, as illustrated in FIG. 9. The ink reloading step S105 may further include closing the choke valve 41, connecting the second pouch 33 again to the second upstream end portion 35*a* of the second ink supply passage 35, and opening the detachable valve 42.

Consequently, it is possible to reload the ink of the second pouch 33 corresponding to the amount of the depressurizing in the depressurizing step, to the first pouch 32 via the second ink supply passage 35 and the first upstream end portion 34*a* of the first ink supply passage 34. Thus, ink flows as indicated by arrow A in FIG. 9.

In the present embodiment, as illustrated in FIG. 5, the ink may be loaded to the first pouch 32 at two stages including the operations of step S103 and step S105. After the ink reloading, a small amount of ink may leak from the nozzle 20*a* of the ink head 20. In this case, the control device 38 may cause the suction pump 47 to operate by driving the driving motor 48. Thus, the suction pump 47 can suction the ink leaking from the nozzle 20*a*.

In addition, a process of detaching the first pouch 32 from the first upstream end portion 34*a* of the first ink supply passage 34 in a state where ink has been loaded to the first pouch 32 may be performed. As illustrated in FIG. 6, the choke valve 41 is first closed. Next, the detachable valve 42 is closed by detaching the second pouch 33 from the second upstream end portion 35*a* of the second ink supply passage 35. Subsequently, the first pouch 32 is detached from the first upstream end portion 34*a* of the first ink supply passage 34.

Figure 10:
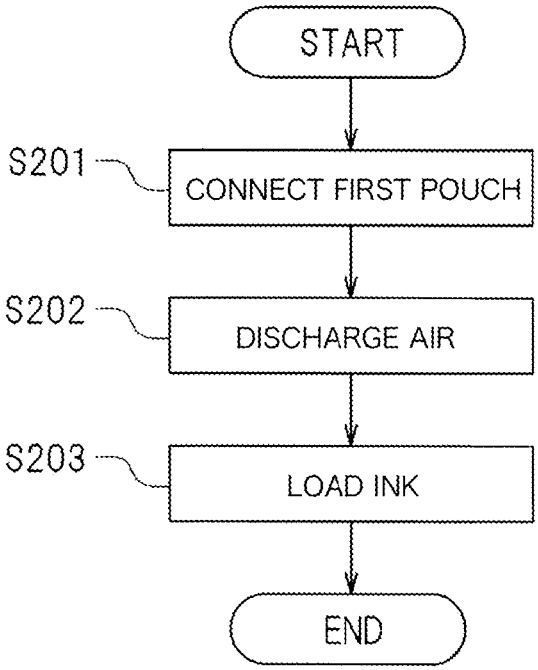
FIG. 10 is a flowchart illustrating a process of loading ink to the first ink supply passage and the second ink supply passage according to another embodiment of the present disclosure.

Next, an embodiment of a method of loading ink to the first ink supply passage 34. and the second ink supply passage 35 in a state where ink is loaded in advance to the first pouch 32 will be described. FIG. 10 is a flowchart illustrating a method of loading ink to the first ink supply passage 34 and the second ink supply passage 35 in a state where ink has been loaded to the first pouch 32.

As illustrated in FIG. 10, the embodiment may include step S201 of connecting the first pouch 32. Connecting the first pouch may include closing the choke valve 41, as illustrated in FIG. 6, detaching the second pouch 33 from the second ink supply passage 35, and closing the detachable valve 42 provided to the second ink supply passage 35.

Next, as illustrated in FIG. 7, connecting the first pouch S201 may further include connecting the first pouch 32 (to which ink has been loaded) to the first upstream end portion 34*a* of the first ink supply passage 34. The embodiment of the method may include step S202 of air discharging, similar to step S102 in FIG. 5. This step may include opening the choke valve 41, as illustrated in FIG. 7, and attaching the cap 46 to the nozzle 20*a* of the ink head 20. Subsequently, the suction pump 47 is caused to operate. Thus, air in the first pouch 32, the first ink supply passage 34, and the second ink supply passage 35 may be externally discharged.

Next, as illustrated in FIG. 10, the embodiment may further include step S203 of ink loading step, similar to step S103 in FIG. 5. As illustrated in FIG. 8, this step includes stopping the suction pump 47, connecting the second pouch 33 to the second upstream end portion 35*a* of the second ink supply passage 35, and closing the detachable valve 42. Further, the embodiment may include loading the ink of the second pouch 33 to the second ink supply passage 35 and the first ink supply passage 34, and, when there is an empty ink content of the first pouch 32, loading the ink to the first pouch 32.

In some embodiments as described above and as illustrated in FIG. 2, the second pouch 33 can be used in addition to the first pouch 32, where the ink amount of the first pouch is detected by the ink amount detecting device 36. Consequently, it is possible to increase a total usable ink amount.

The ink of the first pouch 32 may not supplied to the ink head 20 until the second pouch 33 becomes empty, and the ink of the second pouch 33 is instead supplied to the ink head 20. Hence, regular circulation of ink in and through the first pouch 32 in an amount greater than or equal to the total content of the first pouch 32 is avoided, thus reducing wear and deterioration of the first pouch 32. According to these embodiments, it is possible to provide the printer 1 with the ink supply system 30A which includes the first pouch 32 that reduces wear and deterioration. Further in some embodiments, the first pouch 32 is connected to the first upstream end portion 34*a* of the first ink supply passage 34.

Hence, when the first pouch 32 is detached, the first pouch 32 is detached from the first upstream end portion 34*a* of the first ink supply passage 34, and therefore the first pouch 32 can be easily detached. Thus, such embodiments may avoid issues related to detaching the relay cartridge when the relay cartridge deteriorates, where the relay cartridge is provided between the ink head and the additional ink container.

Further, in such embodiments, if ink in the first pouch 32 forms deposits, the ink can be churned or mixed by detaching and shaking the first pouch 32. Additionally, in some embodiments, the ink in the first pouch 32 may not flow to the first ink supply passage 34 within a certain amount of time.

Hence, if the user connects the first pouch 32 by mistake when an ink of a different color is housed, it is possible to replace the pouch with another first pouch 32 in which the correct color is housed. Thus, the wrong ink does not circulate in the first ink supply passage 34, so that there is no need to exchange the ink in the first ink supply passage 34 and also ink waste is prevented.

As illustrated in FIG. 1, in some embodiments the second pouch 33 may be arranged at the higher position than the first pouch 32. Thus, a hydraulic head difference makes it possible to supply the ink of the second pouch 33 to the ink head 20 instead of the ink of the first pouch 32.

In some embodiments the flow passage resistance of the upstream side portion of the first intermediate portion 34*c* of the first ink supply passage 34 is higher than the flow passage resistance of the upstream side portion of the second downstream end portion 35*b* of the second ink supply passage 35. In this case, the inner diameter of the upstream side portion of the first intermediate portion 34*c* of the first ink supply passage 34 is narrower than the inner diameter of the upstream side portion of the second downstream end portion 35*b* of the second ink supply passage 35.

Thus, the ink of the second pouch 33 is more likely to flow to the ink head 20 than the ink of the first pouch 32. Consequently, the frequency in which the ink of the first pouch 32 is used is reduced, so that wear and deterioration of the first pouch 32 is also reduced.

In some embodiments the second downstream end portion 35*b* of the second ink supply passage 35 is connected to a first upstream end portion 34*a* side of the first intermediate portion 34*c* of the first ink supply passage 34. Thus, the second downstream end portion 35*b* is arranged at a position away from the ink head 20.

Hence, when the ink head 20 moves in the main scan direction Y, the first ink supply passage 34 is not moved according to the ink head 20. Hence, changes in a pressure of the first ink supply passage 34 caused when the ink head 20 moves is reduced.

Additionally, when the first pouch 32 is connected to the first upstream end portion 34*a* of the first ink supply passage 34, the ink in the first downstream end portion 34*b* of the first ink supply passage 34 may produce a reverse flow to the first upstream end portion 34*a*. However, in some embodiments, the choke valve 41 is provided between the first intermediate portion 34*c* and the first downstream end portion 34*b* of the first ink supply passage 34. Hence, the choke valve 41 closes the first ink supply passage 34, so that reverse flow of the ink in the first ink supply passage 34 is prevented.

When the first pouch 32 is connected to the first upstream end portion 34*a* of the first ink supply passage 34, the ink of the second pouch 33 may produce a reverse flow to the first upstream end portion 34*a* of the first ink supply passage 34. However, in some embodiments, the detachable valve 42 is provided to the second ink supply passage 35. Consequently, the detachable valve 42 closes the second ink supply passage 35 so that reverse flow of the ink of the second pouch 33 to the first upstream end portion 34*a* is prevented.

In some embodiments, the ink supply system 30A includes the cap 46 which is attached or operably coupled to the ink head 20 to cover the nozzle 20*a* of the ink head 20, and the suction pump 47 which suctions air from the cap 46. Thus, the first pouch 32 may be connected or operably coupled to the first upstream end portion 34*a* of the first ink supply passage 34, the choke valve 41 may be opened, and the detachable valve 42 may be closed.

In this state, by attaching or coupling the cap 46 to the ink head 20 and causing the suction pump 47 to operate, it is possible to externally discharge air from the first pouch 32, the first ink supply passage 34, and the second ink supply passage 35. Hence, it is possible to prevent the mixture of ink and air in the first pouch 32, the first ink supply passage 34, and the second ink supply passage 35.

In other embodiments as illustrated in FIG. 5, the suction pump 47 is caused to operate in the air discharging step (step S102), so that after air in the first pouch 32, the first ink supply passage 34, and the second ink supply passage 35 is discharged, the ink of the second pouch 33 is loaded to the first pouch 32, the first ink supply passage 34, and the second ink supply passage 35 in the ink loading step (step S103). Consequently, it is possible to prevent the ink from being loaded in a state where air remains in the first pouch 32, the first ink supply passage 34, and the second ink supply passage 35.

In an embodiment, after the ink loading step (step 103), the first pouch 32 is depressurized at step S104, and then the ink of the second pouch 33 is loaded to the first pouch 32 in the ink reloading step S105. Consequently, by depressurizing the first pouch 32, it is possible to further load ink corresponding to the amount of depressurizing to the first pouch 32.

In an embodiment as illustrated in FIG. 6, after the choke valve 41 and the detachable valve 42 are closed, the first pouch 32 may be detached from the first upstream end portion 34*a* of the first ink supply passage 34. As the choke valve 41 and the detachable valve 42 are closed, when the first pouch 32 is detached from the first upstream end portion 34*a* of the first ink supply passage 34, the ink in the first ink supply passage 34 and the second ink supply passage 35 does not produce reverse flow to the first upstream end portion 34*a* of the first ink supply passage 34.

Figure 11:
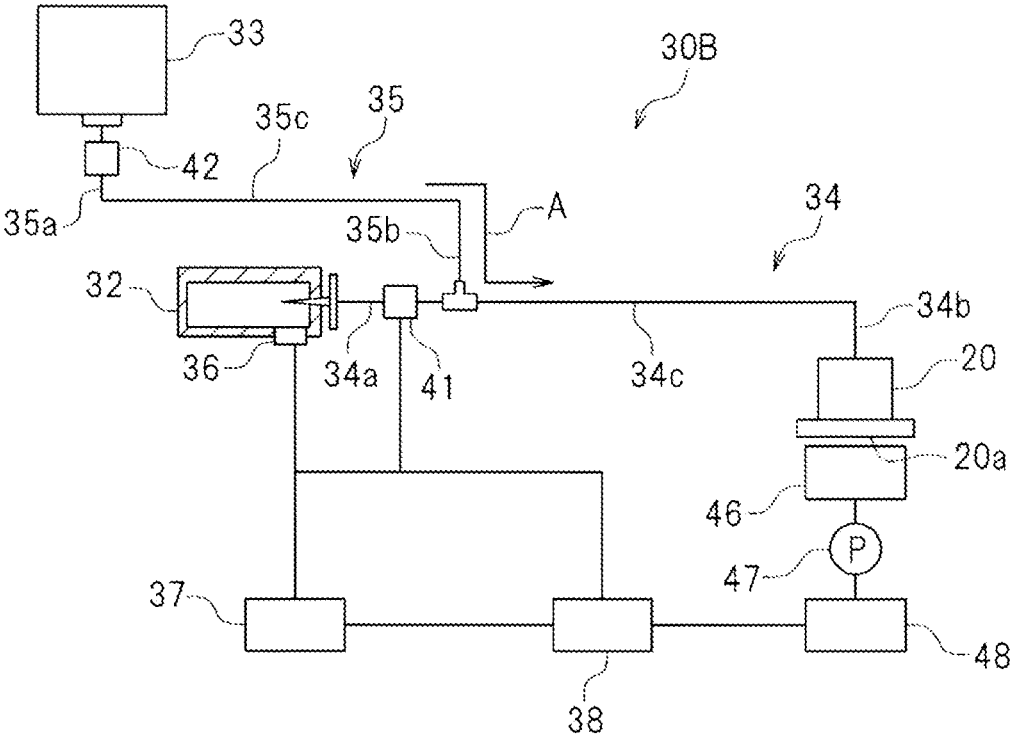
FIG. 11 is a schematic view illustrating an ink supply system according to another embodiment of the present disclosure.

Next, another embodiment of an ink supply system 30B will be described where the position of the choke valve 41 is varied. FIG. 11 is a schematic view illustrating the ink supply system 30B according to an embodiment.

As illustrated in FIG. 11, the choke valve 41 may be provided between a first upstream end portion 34*a* and the first intermediate portion 34*c* of the first ink supply passage 34. In this regard, the choke valve 41 is provided closer to an upstream side of the first ink supply passage 34 than a position of the first intermediate portion 34*c* connected with a second downstream end portion 35*b* of a second ink supply passage 35.

Next, an embodiment of a method of loading ink to an empty first pouch 32, the first ink supply passage 34, and the second ink supply passage 35 will be described. First, the first pouch 32 may be detached from the first upstream end portion 34*a* of the first ink supply passage 34. A second pouch 33 may be detached from a second upstream end portion 35*a* of the second ink supply passage 35.

Similar to the embodiments of the methods discussed above, the embodiment may include a step of connecting the first pouch 32 as discussed in step S101 in FIG. 5, an air discharging step as discussed in step S102, an ink loading step as discussed in step S103, a depressurizing step as discussed in step S104, and an ink reloading step as discussed in step S105. In this regard, in the ink reloading step in step S105, the choke valve is placed in an opened state.

Consequently, it is possible to reload the ink of the second pouch to the first pouch 32 via the second ink supply passage 35 and the first upstream end portion 34*a* of the first ink supply passage 34. The embodiment may further include operations similar to the remaining steps discussed with respect to FIG. 5 and therefore will not be described again here in detail.

Various embodiments have been discussed in which a second valve provided to a second ink supply passage 35 is a detachable valve 42. The detachable valve 42 opens or closes the second ink supply passage 35 in association with attachment or detachment of a second pouch 33 to or from a second upstream end portion 35*a*.

However, the second valve according to other embodiments may be a choke valve. In this case, an arrangement position of the choke valve is not particularly limited, and may be between the second upstream end portion 35*a* and a second intermediate portion 35*c* of the second ink supply passage 35 or may be between the second intermediate portion 35*c* and the second downstream end portion 35*b*. Thus, the choke valve can open or close the second ink supply passage 35 without attaching or detaching the second pouch 33.

Additionally, various embodiments have been discussed wherein the inner diameter of an upstream side portion of a first intermediate portion 34*c* of a first ink supply passage 34 is narrower than an inner diameter of an upstream side portion of a second downstream end portion 35*b* of the second ink supply passage 35. However, the inner diameter of the first ink supply passage 34 and the inner diameter of the second ink supply passage 35 may be the same in some embodiments.

In this case, at an upstream side portion of the first intermediate portion 34*c* of the first ink supply passage 34, an orifice may be provided. Thus, it is possible to make a flow channel resistance of the upstream side portion of the first intermediate portion 34*c* of the first ink supply passage 34 higher than a flow passage resistance of the upstream side portion of the second downstream end portion 35*b* of the second ink supply passage 35.

The foregoing disclosed embodiments and features are merely exemplary and are not to be construed as limiting the present invention. The present teachings can be readily applied to other types of apparatuses and processes. The description of such embodiments is intended to be illustrative, and not to limit the scope of the claims. Many alternatives, modifications, and variations will be apparent to those skilled in the art.

What is claimed is:

1. An ink supply system comprising:

an ink head comprising a nozzle and configured to eject ink;

a first ink container configured to store ink;

a second ink container configured to store ink;

a first ink supply passage comprising:

a first upstream end portion coupled to the first ink container;

a first downstream end portion coupled to the ink head; and an intermediate portion positioned between the first upstream end portion and the first downstream end portion;

a second ink supply passage comprising:

a second upstream end portion coupled to the second ink container; and a second downstream end portion coupled to the intermediate portion, wherein ink from the second ink container is supplied to the ink head via the second upstream end portion; the second downstream portion; the intermediate portion; and the first downstream end portion;

an ink amount detecting device configured to detect an amount of ink in the first ink container; and a notifying device configured to provide a notification when the detected amount of ink is less than or equal to a threshold amount.

2. The ink supply system according to claim 1, wherein the second ink container is arranged at a higher position than the first ink container.

3. The ink supply system according to claim 1, wherein a flow passage resistance of an upstream side portion of the intermediate portion is higher than a flow passage resistance of an upstream side portion of the second downstream end portion.

4. The ink supply system according to claim 3, wherein an inner diameter of the upstream side portion of the intermediate portion is smaller than an inner diameter of the upstream side portion of the second ink supply passage.

5. The ink supply system according to claim 1, wherein the second downstream end portion is coupled to the intermediate portion at an end of the intermediate portion nearest the first upstream end portion.

6. The ink supply system according to claim 1, wherein the first ink supply passage further comprises a first valve between the intermediate portion and the first downstream end portion.

7. The ink supply system according to claim 6, wherein the second ink supply passage further comprises a second valve.

8. The ink supply system according to claim 7, further comprising:

a cap coupled to the ink head and configured to cover the nozzle; and a suction pump configured to suction air from the cap.

9. An ink-jet printer comprising:

an ink supply system, the ink supply system comprising:

an ink head comprising a nozzle and configured to eject ink;

a first ink container configured to store ink;

a second ink container configured to store ink;

a first ink supply passage comprising:

a first upstream end portion coupled to the first ink container;

a first downstream end portion coupled to the ink head; and an intermediate portion positioned between the first upstream end portion and the first downstream end portion;

a second ink supply passage comprising:

a second upstream end portion coupled to the second ink container and a second downstream end portion coupled to the intermediate portion, wherein ink from the second ink container is supplied to the ink head via the second upstream end portion; the second downstream portion; the intermediate portion; and the first downstream end portion;

an ink amount detecting device configured to detect an amount of ink of the first ink container; and a notifying device configured to provide a notification when the detected amount of ink is less than or equal to a threshold amount.

10. A method of supplying ink to an ink supply system, the method comprising:

connecting a first ink container to a first upstream end portion of a first ink supply passage, the first ink supply comprising:

the first upstream end portion;

a first downstream end portion coupled to an ink head;

an intermediate portion positioned between the first upstream end portion and the first downstream end portion; and a first valve between the first upstream end portion and the intermediate portion;

opening the first valve of the first ink supply passage;

closing a second valve of a second ink supply passage, the second ink supply passage comprising a second upstream end portion coupled to a second ink container and a second downstream end portion coupled to the intermediate portion;

discharging air from the first ink container, the first ink supply passage, and the second ink supply passage; and providing ink from the second ink container to the second ink supply passage, the first ink supply passage, and the first ink container by no longer discharging the air and opening the second valve.

11. The method of claim 10, wherein discharging the air comprises attaching a cap to the ink head and causing a suction pump to suction air from the cap.

12. The method of supplying the ink according to claim 11, further comprising:

depressurizing the first ink container by closing the second valve and causing the suction pump to continue suctioning air from the cap; and loading ink in the second ink container by no longer discharging the air and opening the second valve.

13. The method of claim 10, further comprising:

closing the first valve; and detaching the first ink container from the first upstream end portion after closing the first valve and the second valve.

14. The method of claim 10, wherein the second ink container is arranged at a higher position than the first ink container.

15. The method of claim 10, wherein a flow passage resistance of an upstream side portion of the intermediate portion is higher than a flow passage resistance of an upstream side portion of the second downstream end portion.

16. The method of claim 14, wherein an inner diameter of the upstream side portion of the intermediate portion is smaller than an inner diameter of the upstream side portion.

17. The method of claim 10, wherein the second downstream end portion is coupled to the intermediate portion at an end of the intermediate portion nearest the first upstream end portion.

* * * * *